US008979142B2

(12) United States Patent
Curotto

(10) Patent No.: US 8,979,142 B2
(45) Date of Patent: Mar. 17, 2015

(54) LOCKING MECHANISM

(75) Inventor: John Michael Curotto, Sonoma, CA (US)

(73) Assignee: The Curotto-Can, LLC, Chattanooga, TN (US)

( * ) Notice: Subject to any disclaimer, the term of this patent is extended or adjusted under 35 U.S.C. 154(b) by 1203 days.

(21) Appl. No.: 12/774,101

(22) Filed: May 5, 2010

(65) Prior Publication Data

US 2010/0281654 A1 Nov. 11, 2010

Related U.S. Application Data

(60) Provisional application No. 61/175,648, filed on May 5, 2009.

(51) Int. Cl.
*E05F 1/06* (2006.01)
*B65F 3/00* (2006.01)

(52) U.S. Cl.
CPC ..... *B65F 3/00* (2013.01); *B65F 2210/148* (2013.01)
USPC ..... 292/130; 414/408

(58) Field of Classification Search
CPC ..... E05B 15/0093; E05F 1/02; E05F 1/04; E05F 1/043; E05F 1/06; E05F 1/061; E05F 1/063; E05F 1/065; E05F 1/066
USPC ..... 220/315, 326; 414/406, 408, 421, 555; 292/1, 130, 131, 134, 136, 183, 188, 292/189, 194, 195, 230, 231, 232, 234, 238
See application file for complete search history.

(56) References Cited

U.S. PATENT DOCUMENTS

| | | | | | |
|---|---|---|---|---|---|
| 123,267 | A | * | 1/1872 | Large | 292/238 |
| 254,237 | A | * | 2/1882 | Pickering | 292/136 |
| 1,470,630 | A | | 10/1923 | Mahr | |
| 2,069,499 | A | | 2/1937 | Marin et al. | |
| 2,913,029 | A | | 11/1959 | Paton | |
| 3,112,834 | A | | 12/1963 | Dempster et al. | |
| 3,215,182 | A | | 11/1965 | Silverman | |
| 3,321,036 | A | | 5/1967 | Keenan et al. | |
| 3,597,786 | A | | 8/1971 | Ruhl | |
| 3,828,899 | A | * | 8/1974 | Scott | 190/120 |
| 4,042,137 | A | | 8/1977 | Hughes et al. | |
| 4,143,451 | A | | 3/1979 | Craig et al. | |
| 4,152,979 | A | | 5/1979 | Schmidt | |
| 4,155,584 | A | * | 5/1979 | Pracchia | 294/68.26 |
| 4,175,903 | A | | 11/1979 | Carson | |
| 4,575,300 | A | | 3/1986 | George | |
| 4,580,940 | A | | 4/1986 | Sheaves | |

(Continued)

FOREIGN PATENT DOCUMENTS

| | | |
|---|---|---|
| EP | 0860380 | 8/1998 |
| GB | 2082142 | 3/1982 |

OTHER PUBLICATIONS

The Curotto-Can literature, 9 pages.

(Continued)

*Primary Examiner* — Saul Rodriguez
*Assistant Examiner* — Brendan Tighe

(57) ABSTRACT

The disclosure describes a novel approach for restricting the movement of a moveable system. The disclosure describes a novel locking mechanism utilizing a gravity hinge assembly and pocket assembly. The disclosure further describes a novel method for locking a moveable system.

10 Claims, 6 Drawing Sheets

(56) References Cited

U.S. PATENT DOCUMENTS

| | | | | |
|---|---|---|---|---|
| 4,631,777 | A | 12/1986 | Takimoto | |
| 4,687,405 | A | 8/1987 | Olney | |
| 4,722,270 | A | 2/1988 | Wall | |
| 4,726,726 | A | 2/1988 | Dossena et al. | |
| 4,889,462 | A | 12/1989 | Naab et al. | |
| 5,002,450 | A | 3/1991 | Naab | |
| 5,007,786 | A | 4/1991 | Bingman | |
| 5,070,687 | A | 12/1991 | Schweigert | |
| 5,094,487 | A * | 3/1992 | Drewry | 292/237 |
| 5,105,967 | A | 4/1992 | Horpestad | |
| 5,119,894 | A | 6/1992 | Crawford et al. | |
| 5,135,129 | A | 8/1992 | Joly | |
| 5,149,153 | A * | 9/1992 | Drewry et al. | 292/104 |
| 5,209,312 | A | 5/1993 | Jensen | |
| 5,218,781 | A | 6/1993 | Miller | |
| 5,224,744 | A * | 7/1993 | Michelutti | 292/234 |
| 5,230,393 | A | 7/1993 | Mezey | |
| 5,244,109 | A | 9/1993 | Mullett et al. | |
| 5,265,311 | A | 11/1993 | Gard | |
| 5,266,000 | A | 11/1993 | LeBlanc, Jr. | |
| 5,331,763 | A | 7/1994 | Miller | |
| 5,415,314 | A | 5/1995 | McCollum | |
| 5,447,405 | A | 9/1995 | Bayne et al. | |
| 5,565,846 | A | 10/1996 | Geiszler et al. | |
| 5,622,277 | A | 4/1997 | Van Giezen et al. | |
| 5,641,947 | A | 6/1997 | Riddle, Jr. | |
| 5,738,395 | A * | 4/1998 | Probst | 292/230 |
| 5,784,947 | A | 7/1998 | Bayne et al. | |
| 5,807,056 | A | 9/1998 | Osborn et al. | |
| 5,826,485 | A | 10/1998 | Bayne et al. | |
| 5,837,945 | A | 11/1998 | Cornwell et al. | |
| 5,941,405 | A | 8/1999 | Scales et al. | |
| 6,027,299 | A | 2/2000 | Williams | |
| 6,139,244 | A | 10/2000 | VanRaden | |
| 6,167,795 | B1 | 1/2001 | Bayne et al. | |
| 6,191,691 | B1 | 2/2001 | Serrault | |
| 6,220,647 | B1 | 4/2001 | Winkler | |
| 6,224,317 | B1 | 5/2001 | Kann et al. | |
| 6,253,376 | B1 | 7/2001 | Ritter | |
| 6,422,800 | B1 | 7/2002 | Reichow et al. | |
| 6,666,485 | B1 * | 12/2003 | Moret | 292/130 |
| 6,687,656 | B2 | 2/2004 | Durbin et al. | |
| 6,749,076 | B2 | 6/2004 | Fingerhut et al. | |
| 6,761,414 | B1 | 7/2004 | Broberg | |
| 6,773,054 | B2 | 8/2004 | Martini | |
| 6,821,074 | B2 | 11/2004 | Schreiber et al. | |
| 6,863,249 | B1 | 3/2005 | Alvord | |
| 7,000,289 | B2 | 2/2006 | Cedrone | |
| 7,146,294 | B1 | 12/2006 | Waitkus, Jr. | |
| 7,151,231 | B2 | 12/2006 | Kamakau | |
| 7,198,166 | B2 | 4/2007 | Sholinder | |
| 7,210,890 | B2 | 5/2007 | Curotto et | |
| 7,296,704 | B2 | 11/2007 | Ferrini | |
| 7,313,887 | B2 | 1/2008 | Hibbs et al. | |
| 7,347,657 | B2 | 3/2008 | Brunn | |
| 7,390,159 | B2 | 6/2008 | Rimsa et al. | |
| 7,396,996 | B1 | 7/2008 | Shotey et al. | |
| 7,607,628 | B2 | 10/2009 | Elder et al. | |
| 7,633,020 | B2 | 12/2009 | Santi et al. | |
| 7,737,372 | B2 | 6/2010 | Dougherty et al. | |
| 7,897,884 | B2 | 3/2011 | Harish | |
| 8,330,059 | B2 | 12/2012 | Curotto | |
| 8,550,764 | B2 | 10/2013 | Rowland et al. | |
| 2001/0000464 | A1 | 4/2001 | Beale | |
| 2005/0095096 | A1 | 5/2005 | Curotto et al. | |
| 2006/0127202 | A1 | 6/2006 | Tryggvason | |
| 2007/0278019 | A1 | 12/2007 | Santi et al. | |
| 2010/0089916 | A1 | 4/2010 | Fielden | |
| 2010/0183410 | A1 | 7/2010 | Curotto | |
| 2010/0206642 | A1 | 8/2010 | Curotto | |
| 2011/0038696 | A1 | 2/2011 | Ummel, Jr. | |
| 2011/0188976 | A1 | 8/2011 | Rowland et al. | |
| 2011/0266296 | A1 | 11/2011 | Curotto | |
| 2012/0273498 | A1 | 11/2012 | Curotto | |
| 2013/0195590 | A1 | 8/2013 | Goedken | |
| 2014/0010630 | A1 | 1/2014 | Curotto | |

OTHER PUBLICATIONS

Curotto, John Michael, "Curotto Scale System Project", Dec. 1, 2008, 12 pgs.

The Curotto-Can literature, 9 pages, Publication Date: Jun. 21, 2010.

* cited by examiner

LOCKING MECHANISM

RELATED APPLICATIONS

This application claims the benefit of U.S. Provisional Application No. 61/175,648, filed May 5, 2009, and entitled, "Locking Mechanism", which is hereby incorporated herein by reference.

INTRODUCTION

Several types of waste collection vehicles exist. Waste collection vehicles can be front loaders, rear loaders, automated side loaders, and grapple trucks. Waste collection vehicles are typically utilized to pick up quantities of waste for hauling to a determined area, such as a landfill, transfer station, or material recovery facility. Waste collection vehicles can be further utilized or modified to collect recyclables or other materials for transport.

The allocation of waste removal equipment has been improved by the use of large trucks having compaction capabilities extending their effective range and capacity between unloadings. Further, the vehicles have been improved by utilizing specialized hoists to lift containers or intermediate bins into the truck. Additionally, vehicles with intermediate bins have been further improved by adding automated tipper systems, such as robotic arms, for lifting waste containers into the intermediate bin. The use of hoists, lifts, and automated tipper systems increases the efficiency of waste collection vehicles.

SUMMARY

The disclosure describes a novel approach for restricting the movement of a moveable system. The disclosure describes a novel locking mechanism utilizing a gravity hinge assembly and pocket assembly. The disclosure further describes a novel method for locking a moveable system.

In part, this disclosure describes a method for locking a moveable system to an intermediate bin. The method includes performing the following steps:

a) adjusting a counterweight on an extender causing the extender to rotate on a pivot of a gravity hinge assembly attached to an intermediate bin when the intermediate bin is lifted to an angle of greater than a predetermined angle relative to a rest position; and b) locking a moveable system with the extender abutting against a stop plate of a pocket assembly on the moveable system when the intermediate bin is lifted to an angle greater than the predetermined angle.

Another aspect of this disclosure describes a locking mechanism that includes: a gravity hinge assembly attached to a moveable system; and a pocket assembly attached to an intermediate bin, the moveable system is attached to the exterior of the intermediate bin.

The gravity hinge assembly includes an extender and a pivot, the pivot is attached to the extender and allows the extender to rotate between an engaged position and a disengaged position. The pocket assembly includes a stop plate and an opening, the opening is positioned to receive the extender in the engaged position when the moveable system is at rest. The moveable system is prevented from extending away from the intermediate bin when the extender is in the engaged position.

Yet another aspect of this disclosure describes a locking mechanism that includes: a gravity hinge assembly attached to an intermediate bin; and a pocket assembly attached to a moveable system, the moveable system is attached to the exterior of the intermediate bin.

The gravity hinge assembly includes an extender, and a pivot, the pivot is attached to the extender and allows the extender to rotate between an engaged position and a disengaged position. The pocket assembly includes a stop plate, and an opening, the opening is positioned to receive the extender in the engaged position when the moveable system is at rest. The moveable system is prevented from extending away from the intermediate bin when the extender is in the engaged position.

These and various other features as well as advantages which characterize the systems and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The following drawing figures, which form a part of this application, are illustrative of embodiment systems and methods described below and are not meant to limit the scope of the invention in any manner, which scope shall be based on the claims appended hereto.

DETAILED DESCRIPTION

Figure 1:
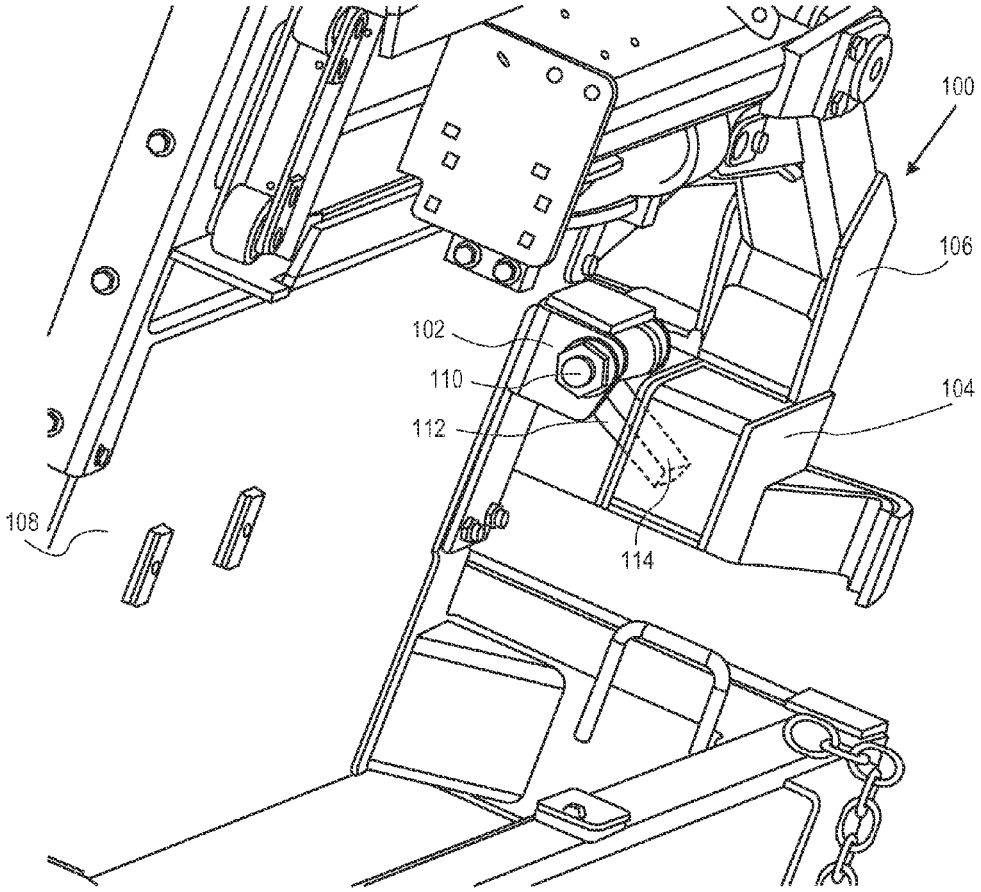
FIG. 1 is a schematic diagram of one embodiment of a locking mechanism in an engaged position.

One aspect of the present disclosure relates to a locking mechanism. The locking mechanism includes a gravity hinge assembly and a pocket assembly.

The locking mechanism locks any movable system attached to a supporting device, such as the exterior of an intermediate bin on a waste collection vehicle. The locking mechanism prevents the moveable system from moving to perform its intended function. The movement restriction created by the locking mechanism prevents the moveable system from getting caught or damaged during dumping, stowing, and/or traveling.

An intermediate bin is any bin suitable for storing materials, such as waste or recyclables, and for being lifted, dumped, and/or stowed in the hopper of a waste collection vehicle. The intermediate bin may be detachable or non-detachable from the waste collection vehicle.

Currently, intermediate bins with automated tipper systems utilize gravity hooks to prevent moveable systems, such as automated tipper systems, attached to the intermediate bin from moving during dumping, stowing, and traveling. While gravity hooks may successfully prevent movable systems, such as robotic arms, from moving during stowing and dumping, the gravity hook requires frequent, continued maintenance and adjustments as time wears on the pivot pin to remain effective. The gravity hook only protects against a lift function, unlike the embodiments of the locking mechanism described herein which prevent lifting and sliding of the moveable system. Further, the gravity hook may break if the moveable system is improperly utilized. Additionally, the moveable parts of the gravity hook are attached to the moveable system and can get damaged during typical use of the moveable system.

The embodiments of the locking mechanism described herein prevent the need for continued maintenance and adjustments. Further, the moveable parts of the locking mechanism may be attached to a supporting device to prevent the moveable parts of the locking mechanism from being damaged during the use of the moveable system. Additionally, the locking mechanism will not break even if the moveable system is activated or improperly utilized when locked by the locking mechanism.

Further, unlike the gravity hook, the locking mechanism as disclosed herein is adjustable. The angle of engagement, depending on the desired results, can be tuned for early engagement by reducing a counterweight mass. A second adjustment can be made by adjusting the shims on the pivot mount (shaft, bolt). Shimming can result in a tight or loose engagement and can be made to address specific operational requirements.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the scope of the equipment and methods described herein.

Reference will now be made in detail to various features of the present disclosure that are illustrated in the accompanying drawings. Wherever possible, the same reference numbers will be used throughout the drawings to refer to the same or like parts.

Figure 4:
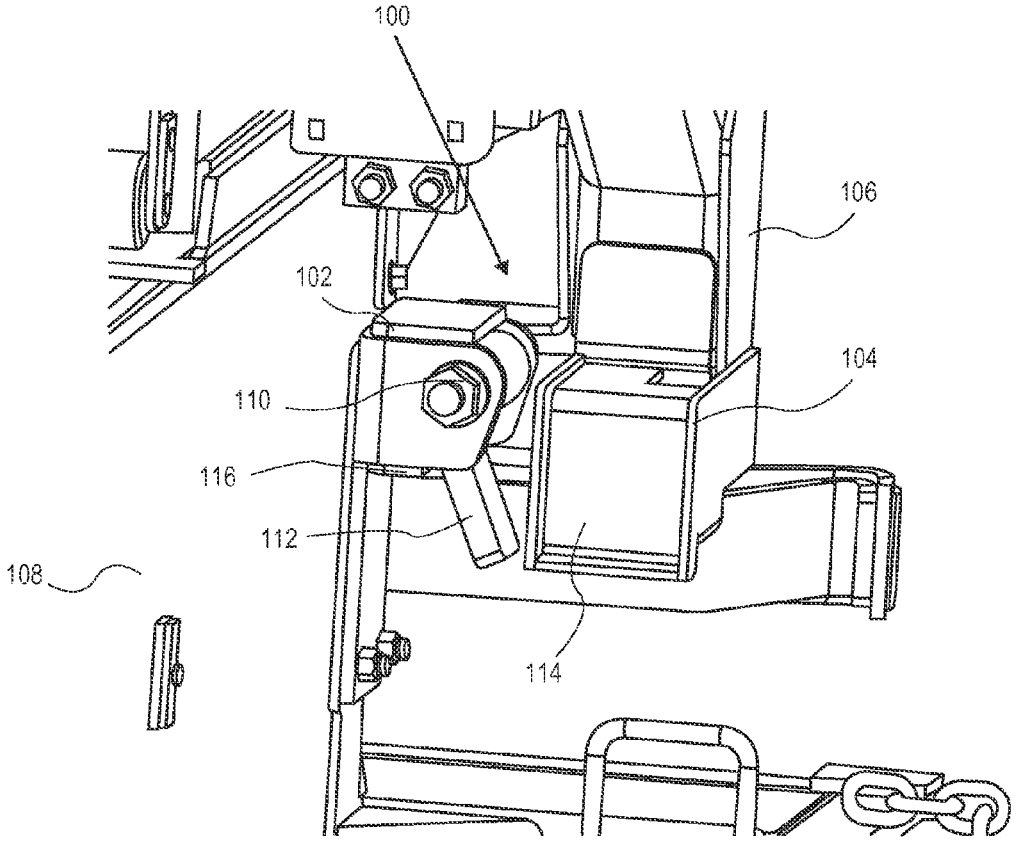
FIG. 4 is a schematic diagram of one embodiment of a locking mechanism in a disengaged position.
Figure 5:
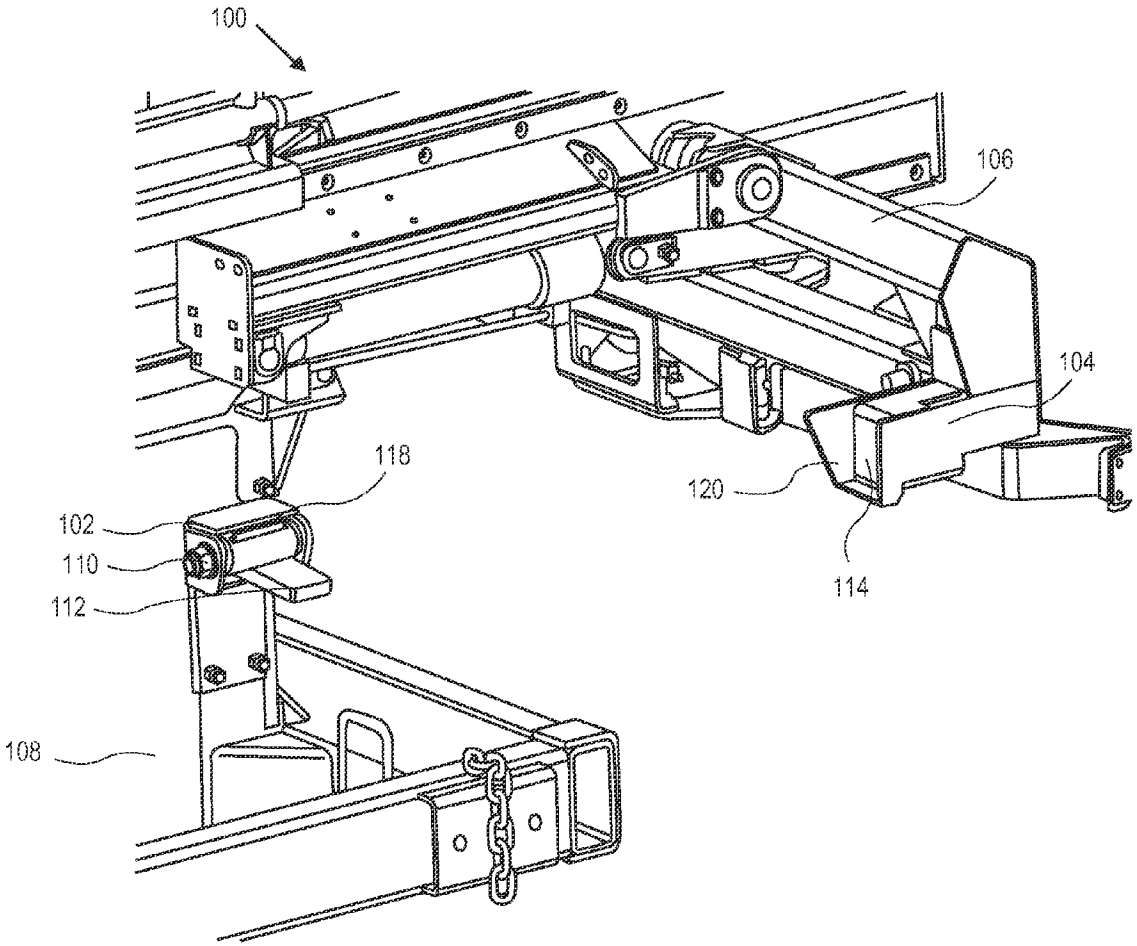
FIG. 5 is a schematic diagram of one embodiment of a locking mechanism in a disengaged position.

FIGS. 1, 4, and 5 illustrate embodiments of a locking mechanism 100. The illustrated locking mechanism 100 includes a gravity hinge assembly 102 and a pocket assembly 104. The locking mechanism 100 provides a mechanism for preventing a moveable system 106 attached to a supporting device, such as an intermediate bin 108 of a waste collection vehicle from moving during dumping, traveling, or stowing. In one embodiment the locking mechanism 100 prevents movement of the moveable system 106 during lifting of the intermediate bin 108 into the hopper or during storage of the intermediate bin 108 in the hopper of a waste collection vehicle.

The moveable system 106 can be an automated tipper system, such as a robotic arm or a gripper system. The locking mechanism 100 may be utilized on any of the intermediate bins and tipper systems or robotic arms or similar systems described in U.S. Pat. No. 7,210,890 issued May 1, 2007 and U.S. Patent Application Publication Number 20050095096 filed on May 5, 2005, which are incorporated herein by reference in their entirety. In an alternative embodiment, the locking mechanism 100 may be utilized to prevent moveable systems from moving away from supporting devices other than intermediate bins and waste collection vehicles, such as drilling rigs, lifts, and other devices.

Figure 2:
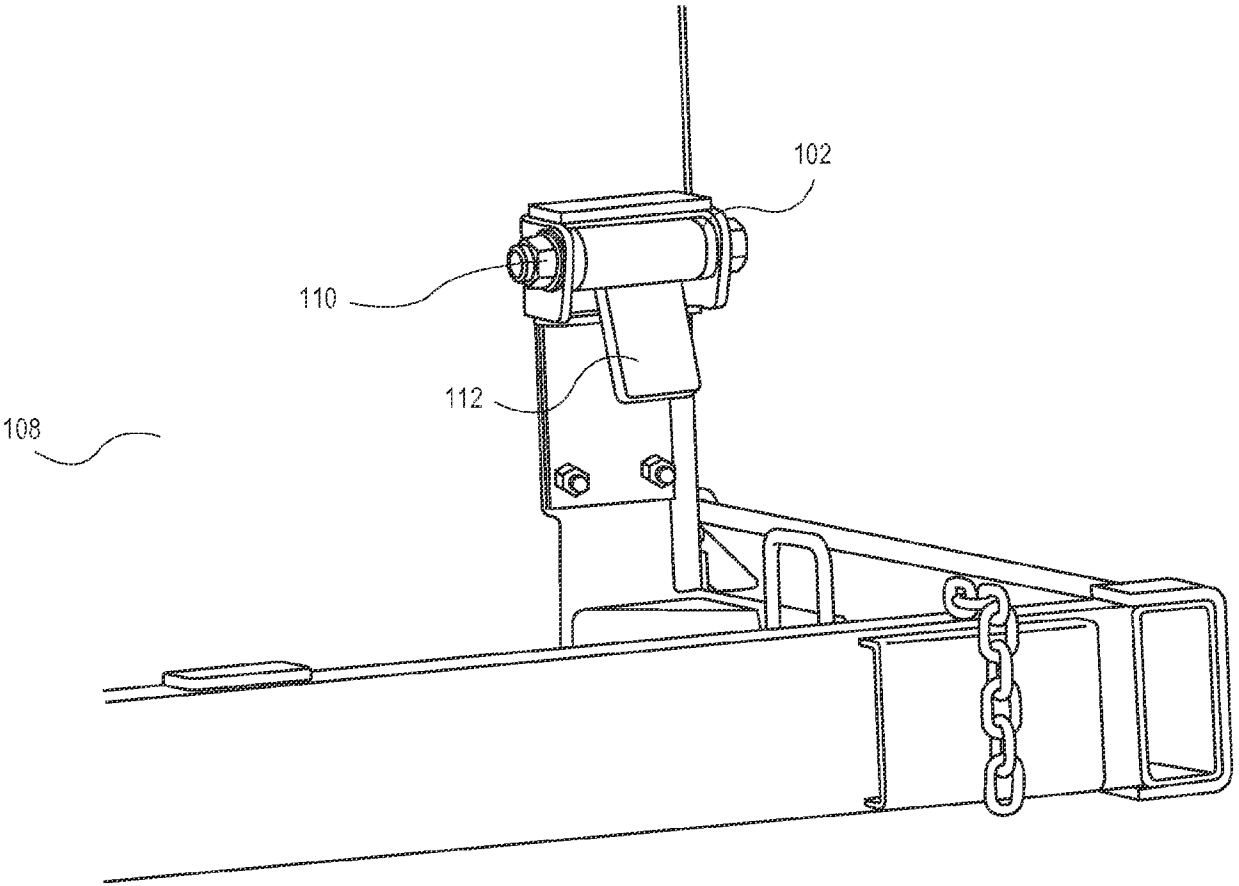
FIG. 2 is a schematic diagram of one embodiment of a gravity hinge assembly.

The gravity hinge assembly 102 can be attached to any suitable portion of the moveable system 106 and supporting device for locking the moveable system 106. In one embodiment, the gravity hinge assembly 102 is attached to an intermediate bin 108 on a waste collection vehicle as illustrated in FIG. 2. In another embodiment, the gravity hinge assembly 102 is attached to the arm of a moveable system 106 on a waste collection vehicle. The gravity hinge assembly 102 may be attached to the intermediate bin 108 or moveable system 106 by any suitable mechanism and by any suitable method to support the locking mechanism 100. In one embodiment, the gravity hinge assembly 102 may be attached through the welding or bolting of a base bracket.

Figure 6:
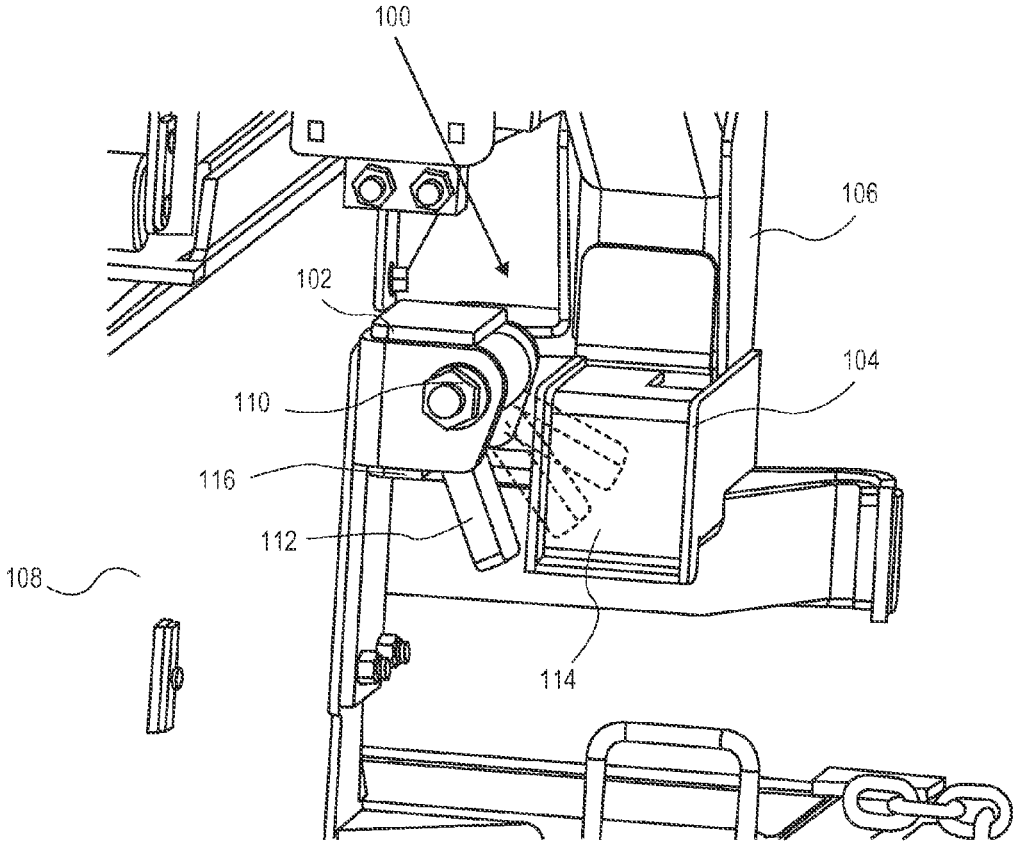
FIG. 6 is a schematic diagram of one embodiment of a locking mechanism moving from a disengaged position to an engaged position.

As illustrated in FIG. 2, the gravity hinge assembly 102 includes a pivot 110 and an extender 112. The extender 112 is attached to the pivot 110. The pivot 110 allows the extender 112 to pivot around a pivot pin. The extender 112 rotates between an engaged position and a disengaged position as illustrated in FIG. 6. In one embodiment, the rotation of the extender 112 is determined by gravity. The extender 112 is in a disengaged position when the extender 112 is not located within an opening of a pocket assembly 104 as illustrated in FIG. 4. In another embodiment, the extender 112 rotates into a disengaged position when the intermediate bin 108 is lifted 20 degrees or less from a rest position. The intermediate bin 108 is in a rest position when the forks of the fork assembly of the waste collection vehicle attached to the intermediate bin 108 are substantially parallel to the ground. As used herein the term "substantially parallel" means being five degrees or less from being parallel.

The extender 112 is in an engaged position when the extender 112 enters an opening of the pocket assembly 104 as illustrated in FIG. 1. In one embodiment, the extender 112 rotates into an engaged position when the intermediate bin 108 is lifted more than 20 degrees from a rest position. In alternative embodiments, other predetermined angles for rotation into the engaged position may be used as desired for a particular applications, such as for example about 10, 15, and 25 degrees although any angle between about 0 and about 90 degrees may be used.

Unlike the gravity hook, the activation of the locking mechanism 100 is adjustable. The gravity hinge assembly 102 may be adjusted to allow the extender 112 to rotate at different degrees of force. In one embodiment, the extender 112 is balanced with a counterweight. The counterweight may be increased or decreased to affect the amount of force necessary to move the extender 112. An extender 112 with more counterweight requires more force or an intermediate bin 108 to be lifted farther up to rotate the extender 112. An extender 112 with less counterweight requires less force or the intermediate bin 108 to be lifted less far to move the extender 112. Accordingly, the counterweight of the extender 112 can be adjusted to achieve a desired force for moving the extender 112.

In one embodiment, the gravity hinge assembly 102 may further include a hinge stop 116 or a stop bar 118 as illustrated in FIGS. 4 and 5. The hinge stop 116, as shown in FIG. 4, sets the position of the pivot 110 to place the extender 112 at an optimum angle to enter the pocket assembly 104. The hinge stop 116 can be adjusted to allow the extender to rest at a desired angle and in a desired disengaged direction when the intermediate bin is in a rest position. The stop bar 118 as shown in FIG. 5 limits the motion of the extender 112 and pivot 110. The stop bar 118 can be adjusted as desired to cause the extender to stop at a desired angle.

Figure 3A:
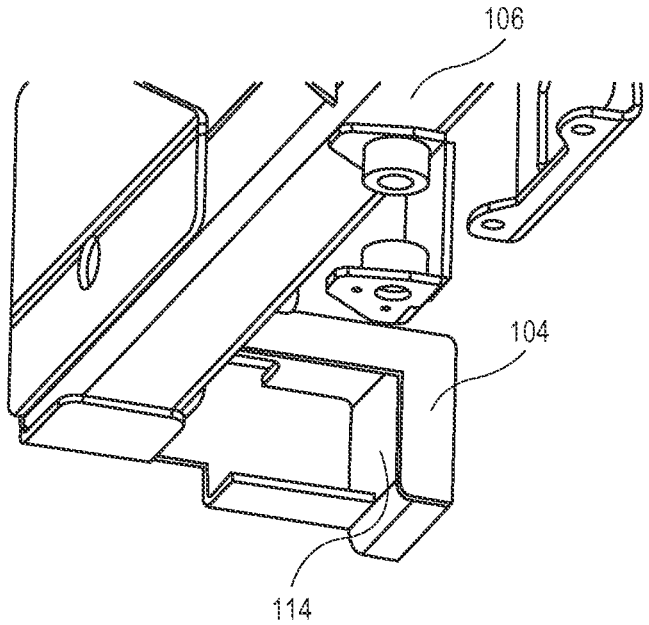
FIG. 3A is a side view of a schematic diagram of one embodiment of a pocket assembly.
Figure 3B:
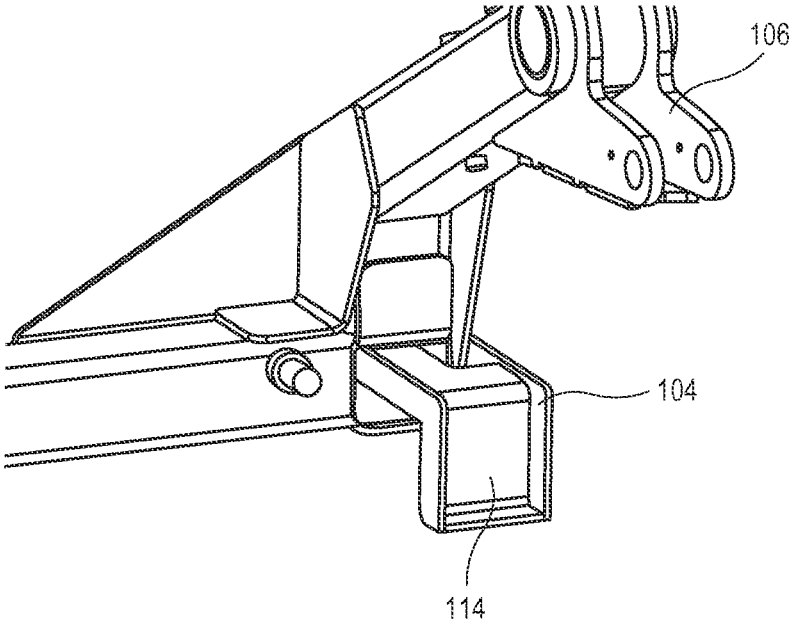
FIG. 3B is a front view of a schematic diagram of the pocket assembly illustrated in FIG. 3A.

The pocket assembly 104 is a chamber with an opening and a stop plate 114. In one embodiment, the chamber is a box-like chamber with an opening and stop plate 114, as illustrated in FIGS. 3A and 3B. The pocket assembly 104 may be attached to the moveable system 106 or supporting device by any suitable mechanism, by any suitable method, and in any suitable position to support the locking mechanism 100. In one embodiment, a side of the pocket assembly 104 is welded to the moveable system 106. In another embodiment, the pocket assembly 104 is attached to the intermediate bin 108. The opening of the pocket assembly 104 provides a space for the extender 112 of the gravity hinge assembly 102 to enter the pocket assembly 104.

Once the extender 112 enters the pocket assembly 104, the extender 112 is in an engaged position preventing the moveable system 106 from moving away from the supporting device or locking out the moveable system 106. The moveable system 106 is prevented from moving because the stop plate 114 of the pocket assembly 104 will contact the extender 112 of the gravity hinge assembly 102 and prevent any movement of the moveable system 106. In an embodiment, the stop plate 114 of the pocket assembly 104 has a rounded edge to allow the extender 112 to move easily between the engaged and disengaged position. In one embodiment, the rounded edge is the edge of the pocket assembly 104 that is closest to the ground when the moveable system is in a rest position. The rest position of the moveable system 106 is the position the moveable system 106 is placed in, in relation to the supporting device, between activations or during storage. In one embodiment, the locking mechanism 100 prevents the moveable system 106 from moving away from intermediate in more than one direction.

In one embodiment, the locking mechanism further includes a pivot lock system. The pivot lock system can be connected or disconnected. In one embodiment, when connected, the pivot lock system prevents the extender 112 from rotating on the pivot 110. Accordingly, when connected, the pivot lock system can hold the extender 112 in an engaged or disengaged position. In another embodiment, when connected, the pivot lock system only holds the extender 112 in an engaged position. In an alternative embodiment, when connected, the pivot lock system only holds the extender 112 in a disengaged position. In one embodiment, the pivot lock system is as simple as threading a pin through aligning pin holes on the pivot 110 and the extender 112 to prevent rotation. However, any suitable system for preventing rotation of the extender 112 on the pivot 110 may be utilized as the pivot lock system. The pivot lock system allows the operator of the moveable system to maintain a lock of the moveable system or to prevent the moveable system from being locked for as long as desired by connecting and disconnecting the pivot lock system.

In another embodiment, the pocket assembly 104 further includes shims. The shims are attached to the pivot 110 and increase the amount of force necessary to rotate the extender 112 around the pivot pin of the pivot 110. A wider shim applies more friction to the pivot pin of the pivot 110. A smaller shim applies less friction to the pivot pin of the pivot 110. Accordingly, the shim or shims may be adjusted to increase or decrease the amount of force required to rotate the extender 112 as desired.

In another embodiment, the pocket assembly 104 is attached to an automated tipper system. In a further embodiment, the pocket assembly 104 is attached to a robotic arm. In another embodiment, the pocket assembly 104 may further comprise a guide piece 120, such as a triangular piece, as illustrated in FIG. 5. The guide piece 120 directs the extender 112 in front of the open space of the pocket assembly 104 when the moveable system 106, such as a robotic arm, is moving into a rest position.

In one embodiment, the locking mechanism 100 is made of metal, such as T-1 steel. The locking mechanism 100 may be made of any suitable material for preventing the moveable system 106 from extending out from the supporting device and/or for withstanding the force of all the cylinders on the moveable system 106.

While various embodiments have been described for purposes of this disclosure, various changes and modifications may be made which are well within the scope of the present invention. Numerous other changes may be made which will readily suggest themselves to those skilled in the art and which are encompassed in the spirit of the disclosure and as defined in the appended claims.

What is claimed is:

1. A locking mechanism comprising:

a gravity hinge assembly attached to an intermediate bin, the gravity hinge assembly comprising:

an extender, and a pivot, the pivot is attached to the extender and allows the extender to rotate between an engaged position and a disengaged position, wherein the pivot and the extender are configured such that a force of gravity rotates the extender into the engaged position via the pivot when the intermediate bin is lifted to an angle of at least 10 degrees from an intermediate bin rest position;

a moveable system, the moveable system is attached to the intermediate bin, wherein the moveable system is an automated tipper system; and a pocket assembly attached to the moveable system, the pocket assembly is a chamber and is not a hook, thechamber comprising:

a stop plate, and an opening, the opening is positioned to receive the extender in the engaged position when the moveable system is in a moveable system rest position, wherein contact between the extender and the pocket assembly prevent the moveable system from extending away from the intermediate bin when the extender is in the engaged position.

2. The locking mechanism of claim 1, wherein the chamber further comprises: a guide piece, wherein the guide piece extends out from the exterior of the chamber, wherein the guide piece is shaped to position the extender in front of the opening of the pocket assembly as the moveable system moves toward the moveable system rest position.

3. The locking mechanism of claim 1, further comprising a hinge stop, the hinge stop is attached the gravity hinge assembly, wherein the hinge stop positions the extender at an optimum angle to enter the pocket assembly.

4. The locking mechanism of claim 1, further comprising a stop bar, the stop bar is attached to the gravity hinge assembly, wherein the stop bar limits the rotation of the extender on the pivot.

5. The locking mechanism of claim 1, further comprising a shim, the shim is attached to the pivot, wherein the shim is positioned to increase an amount of the force required to rotate to the extender.

6. The locking mechanism of claim 1, further comprising a counterweight, the counterweight is attached to the extender, wherein the counterweight is positioned to increase an amount of the force required to rotate the extender.

7. The locking mechanism of claim 1, wherein the stop plate has a rounded edge, the rounded edge is an exterior edge of the pocket assembly adjacent to the opening and positioned closest to ground when the moveable system is in the moveable system rest position.

8. The locking mechanism of claim 1, further comprising a pivot lock system, wherein aligning pin thread holes are located on the pivot and the extender.

9. The locking mechanism of claim 1, wherein the automated tipper system is a robotic arm.

10. A locking mechanism comprising:

a gravity hinge assembly attached to an intermediate bin, the gravity hinge assembly comprising:

an extender, and a pivot, the pivot is attached to the extender and allows the extender to rotate between an engaged position and a disengaged position;

a moveable system, the moveable system is attached to a supporting device, wherein the moveable system is an automated tipper system;

a pocket assembly attached to the moveable system, the pocket assembly comprising a stop plate, and an opening, the opening is positioned to receive the extender in the engaged position when the moveable system is in a moveable system rest position, wherein contact between the extender and the pocket assembly prevent the moveable system from extending away from the intermediate bin when the extender is in the engaged position.

* * * * *